US007431041B2

(12) United States Patent
Wu

(10) Patent No.: US 7,431,041 B2
(45) Date of Patent: Oct. 7, 2008

(54) HUNTING UMBRELLA

(76) Inventor: Hsien-Sao Wu, 12F., No. 24, Jilin Rd., Jhongshan District, Taipei 104 (TW)

( * ) Notice: Subject to any disclaimer, the term of this patent is extended or adjusted under 35 U.S.C. 154(b) by 214 days.

(21) Appl. No.: 11/308,193

(22) Filed: Mar. 10, 2006

(65) Prior Publication Data

US 2007/0209689 A1 Sep. 13, 2007

(51) Int. Cl.
*A45B 11/00* (2006.01)
*A45B 25/18* (2006.01)

(52) U.S. Cl. ..... 135/21; 135/16; 135/33.2; 135/901

(58) Field of Classification Search ..... 135/15.1, 135/20.1, 21, 25.4, 25.41, 33.2, 33.4, 33.41, 135/901; 182/92
See application file for complete search history.

(56) References Cited

U.S. PATENT DOCUMENTS 2,143,978 A * 1/1939 Eeles ..... 135/25.3
2,631,520 A * 3/1953 Geerling ..... 99/516
4,458,707 A * 7/1984 Lindaman ..... 135/90
4,606,366 A * 8/1986 Collet ..... 135/20.1
6,296,005 B1 * 10/2001 Williams et al. ..... 135/98
2002/0036007 A1 * 3/2002 Sellers ..... 135/90
2004/0069334 A1 * 4/2004 Ko ..... 135/25.4

* cited by examiner

*Primary Examiner*—David R Dunn
*Assistant Examiner*—Danielle N Jackson
(74) *Attorney, Agent, or Firm*—Pai Patent & Trademark Law Firm; Chao-Chang David Pai

(57) ABSTRACT

An improved hunting umbrella is disclosed. The improved hunting umbrella of the present invention includes a main body. The main body includes a plurality of ribs, an upper retaining element, a lower retaining element, a piece of fabric and a central pole. A zipper is disposed on the piece of fabric. When the zipper is unzipped, a gap is formed on the piece of fabric. A bendable portion is provided on the central pole so that the central pole may be bent by a certain angle. The improved hunting umbrella of the present invention may be used as an ordinary umbrella as well as a hunting umbrella.

6 Claims, 6 Drawing Sheets

HUNTING UMBRELLA

BACKGROUND OF THE INVENTION

1. Field of the Invention

The invention generally relates to an improved hunting umbrella. More particularly, the invention relates to an improved hunting umbrella that may be used as an ordinary umbrella as well as a hunting umbrella.

2. Description of the Prior Art

The hunting umbrella of the prior art comprises a main body and an extension pole. The main body includes a plurality of ribs, an upper retaining element, a lower retaining element, a central pole and a piece of fabric. A gap is provided on the piece of fabric. The extension pole is connected with the central pole. A drilling piece is provided at the proximal end of the extension pole. When a user wishes to use the hunting umbrella, he may connect the central pole of the main body with the extension pole so that the former is perpendicular to the latter and then attach the drilling piece to the trunk of a tree such that the gap allows a close contact between the umbrella and the trunk; now, the hunting umbrella is securely attached to the trunk of the tree and can protect the user from the sun or the rain during his hunting. However, the hunting umbrella of the prior art has many disadvantages. First, the hunting umbrella of the prior art can not be used as an ordinary umbrella to protect a user from the sun or the rain. Also, the connecting mechanism between the extension pole and the central pole is quite complicated and causes difficulty in the assembly of the umbrella.

Hence, the hunting umbrella of the prior art needs to be improved.

To eliminate the disadvantages of the hunting umbrella of the prior art, the inventor put a lot of effort in the subject and has successfully come up with the improved hunting umbrella of the present invention.

SUMMARY OF THE INVENTION

An object of the present invention is to provide an improved hunting umbrella that may be used as an ordinary umbrella as well as a hunting umbrella.

Another object of the present invention is to provide an improved hunting umbrella that is structurally simple, easy to assemble and very useful.

The improved hunting umbrella of the present invention comprises a main body, an extension pole and a handle. The main body includes a plurality of ribs, an upper retaining element, a lower retaining element, a piece of fabric and a central pole. A zipper is disposed on the piece of fabric. When the zipper is unzipped, a gap may be formed on the piece of fabric. A bendable portion is provided on the central pole so that the central pole may be bent by about 90 degree. A resilient engagement element is disposed near the proximal end of the central pole, and an engagement hole is provided near the distal end of the extension pole. Another resilient engagement element is disposed near the proximal end of the extension pole. When the umbrella is assembled, the distal end of the extension pole is connected with the proximal end of the central pole through the engagement between the resilient engagement element of the central pole and the engagement hole of the extension pole. A threaded hole is provided at the proximal end of the handle so that a fixing piece may be fixed and hidden inside the handle or may extend out of the handle. When the umbrella is assembled, the distal end of the handle is connected with the proximal end of the extension pole through the engagement between the resilient engagement element of the extension pole and the engagement hole of the handle so that the handle is connected with the extension pole and the central pole. When a user wishes to use the hunting umbrella as an ordinary umbrella, he may close the zipper and hence the gap on the piece of fabric; now, the user may use the hunting umbrella to protect himself from the sun or the rain. When a user wishes to use the hunting umbrella as a hunting umbrella, first, he may make the fixing piece extend out of the handle and affix the fixing piece into the trunk of a tree; then, he may bend the central pole by a certain angle with respect to the extension pole; next, he may unzip the zipper (so that a gap may be formed on the piece of fabric) and tie two bands around the trunk; now, the hunting umbrella is securely attached to the trunk of the tree and can protect the user from the sun or the rain during his hunting.

These features and advantages of the present invention will be fully understood and appreciated from the following detailed description of the invention with reference to the accompanying Drawings.

DETAILED DESCRIPTION OF THE PREFERRED EMBODIMENT

Please refer to FIGS. 1 to 4. The improved hunting umbrella of the present invention comprises a main body 1, an extension pole 2 and a handle 3.

Figure 1:
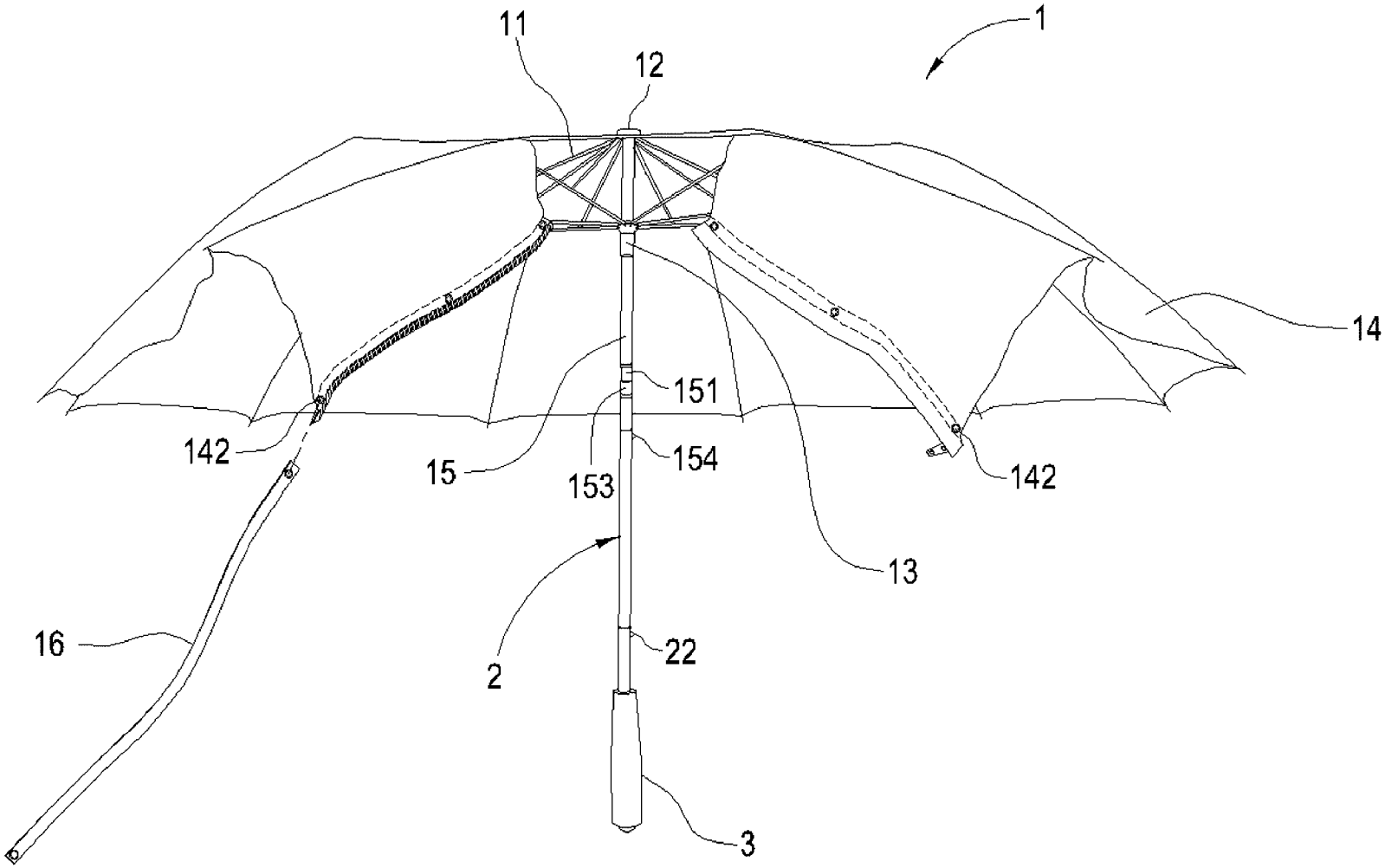
FIG. 1 is a view of the improved hunting umbrella of the present invention.
Figure 2:
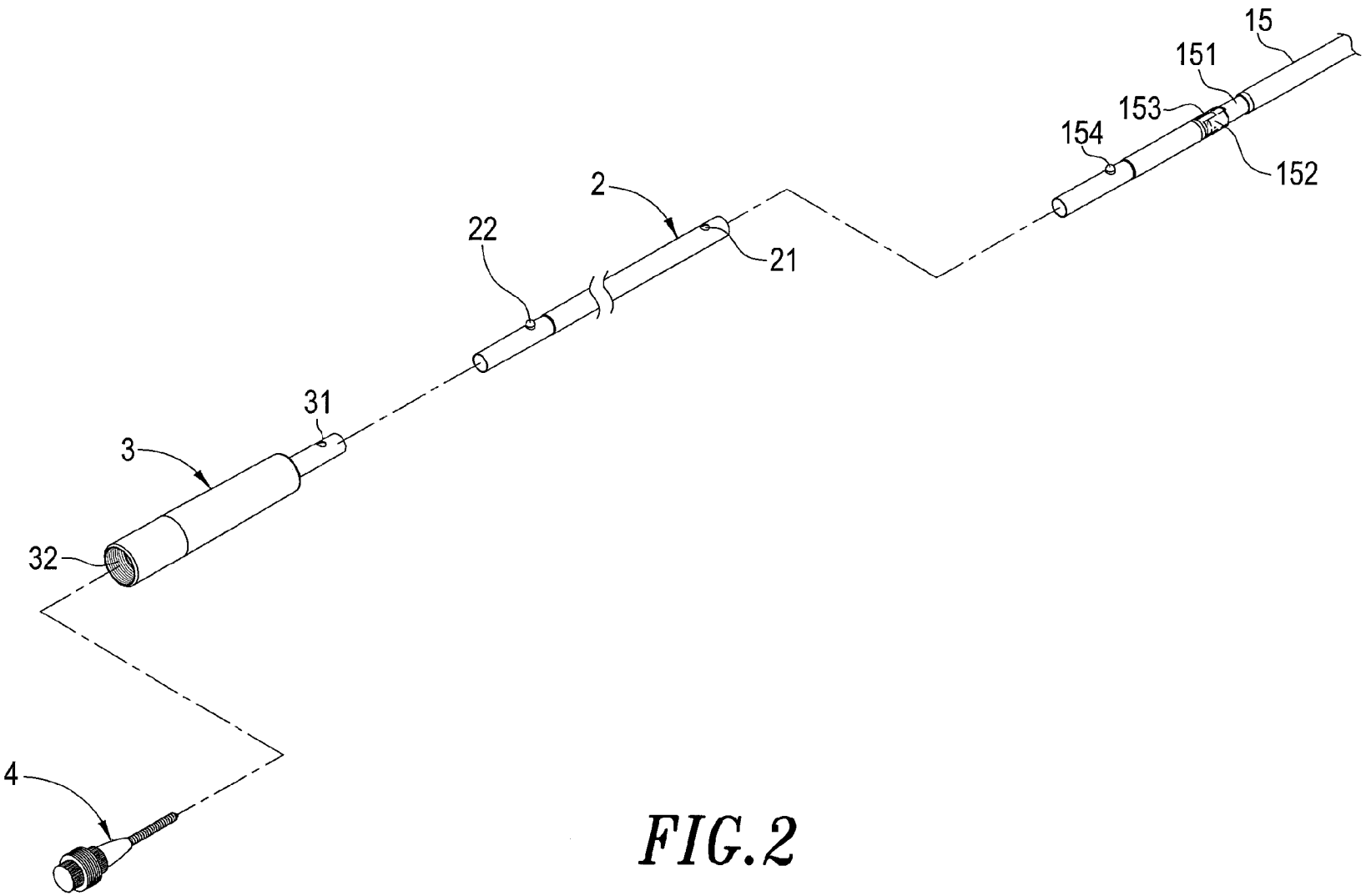
FIG. 2 is a partially exploded view of the improved hunting umbrella of the present invention.
Figure 4:
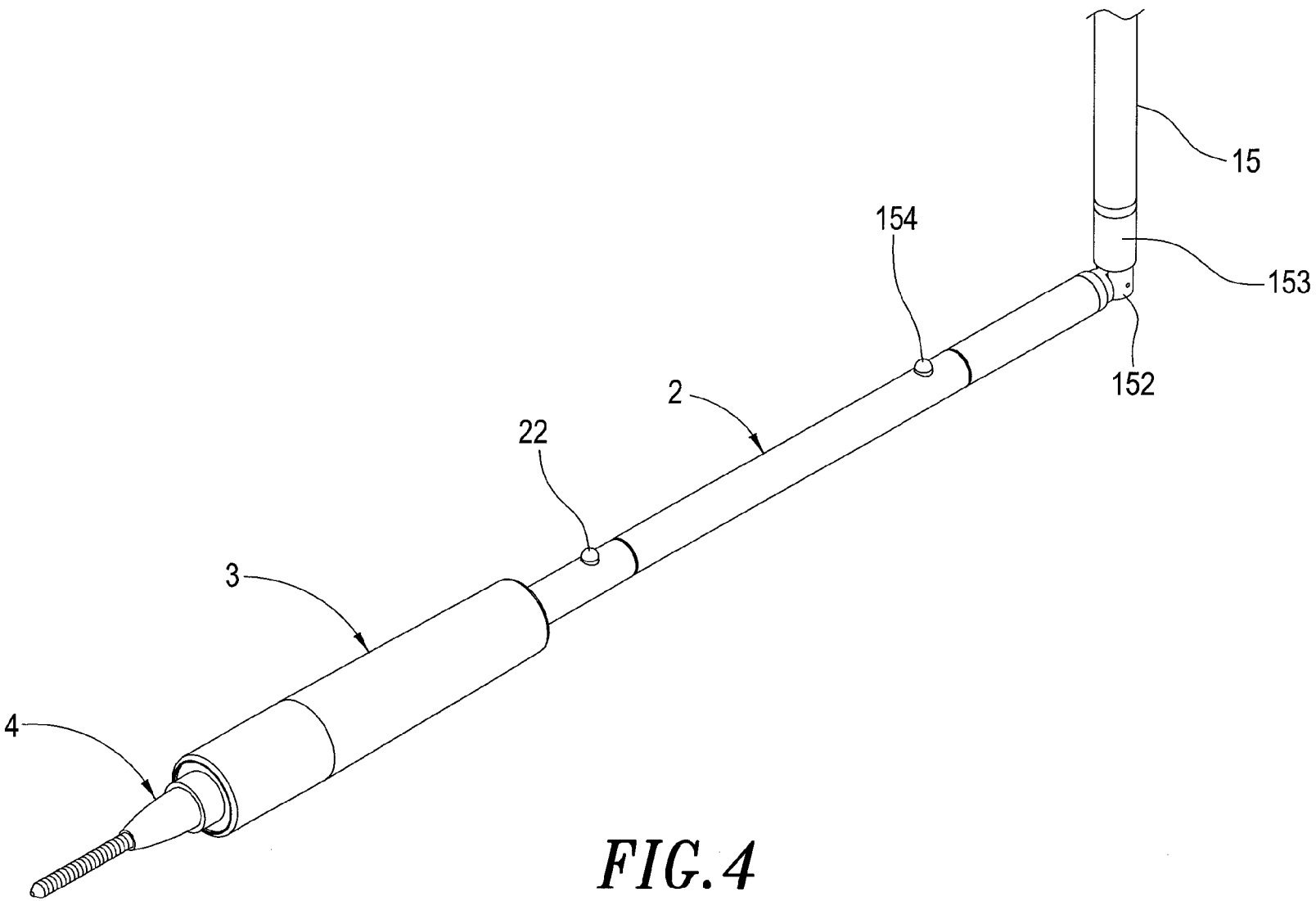
FIG. 4 is a view showing the bending of the improved hunting umbrella of the present invention.

The main body 1 includes a plurality of ribs, an upper retaining element 12, a lower retaining element 13, a piece of fabric 14 and a central pole 15. A zipper 141 is disposed on the piece of fabric 14. When the zipper 141 is unzipped, a gap (as shown in FIG. 1) may be formed on the piece of fabric 14. A plurality of buttons 142 are provided on each side of the zipper 141. Each button 142 may be connected with a band 16. A sliding tubular portion 151 is provided on the central pole 15 (as shown in FIG. 2). A bendable portion 152 is provided on the sliding tubular portion 151. An outer tubular portion 153 is disposed outside of the bendable portion 152 and may move upwards and downwards along the sliding tubular portion 151. When the outer tubular portion 153 is moved to the position of the bendable portion 152, the bendable portion 152 can not be bent. When the outer tubular portion 153 is moved upwards and away from the position of the bendable portion 152, the bendable portion 152 may be bent by about 90 degree (as shown in FIG. 4). A resilient engagement element 154 is disposed near the proximal end of the central pole 15.

The extension pole 2 is a hollow tube. An engagement hole 21 is provided near the distal end of the extension pole 2. A resilient engagement element 22 is disposed near the proximal end of the extension pole 2. When the umbrella is assembled, the distal end of the extension pole 2 is connected with the proximal end of the central pole 15 through the engagement between the resilient engagement element 154 of the central pole 15 and the engagement hole 21 of the extension pole 2; now, the central pole 15 is connected with the extension pole 2.

Figure 3:
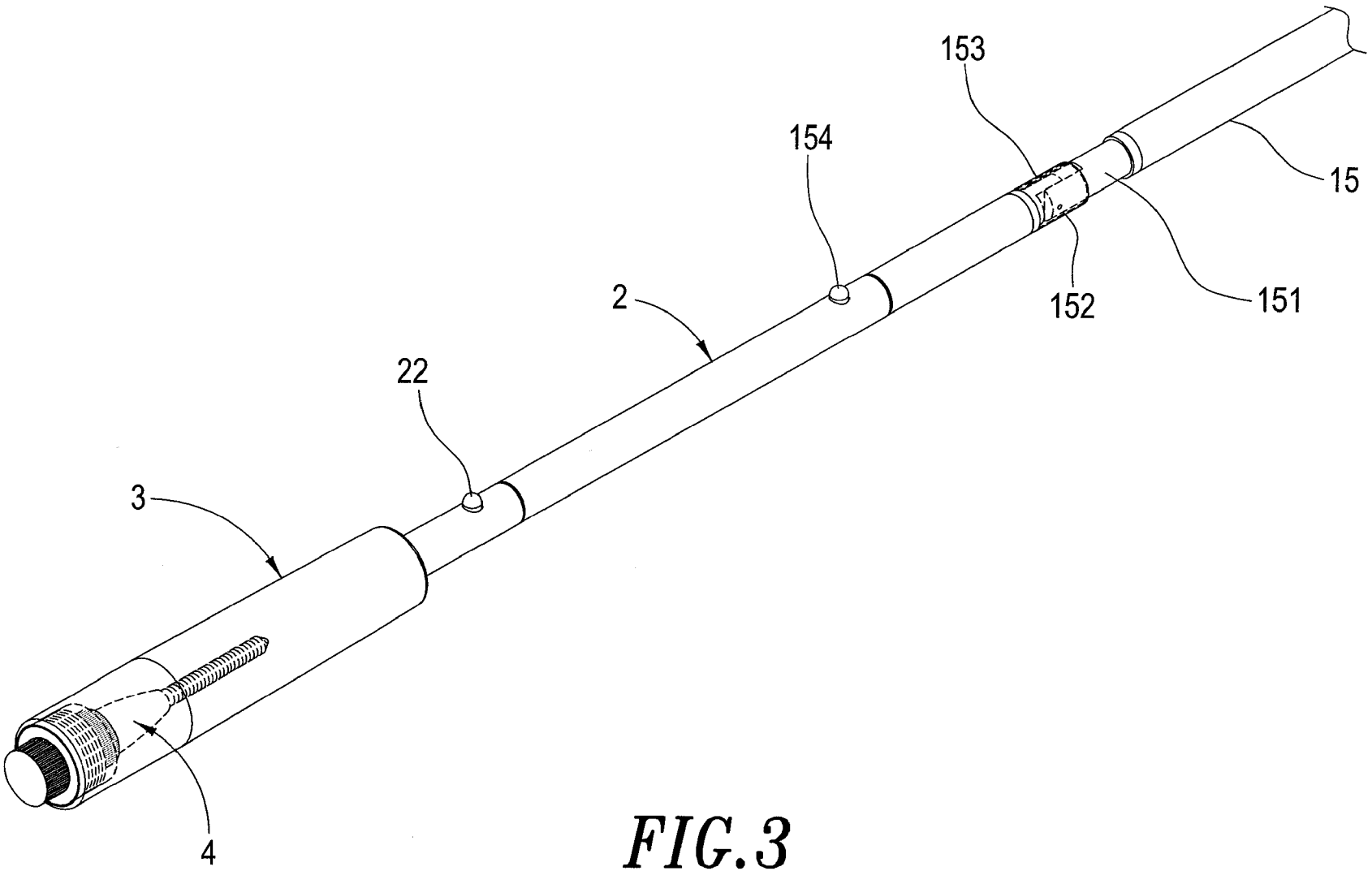
FIG. 3 is a view showing some components of the improved hunting umbrella of the present invention in the assembled condition.

An engagement hole 31 is provided near the distal end of the handle 3. A threaded hole 32 is provided at the proximal end of the handle 3 so that a fixing piece 4 may be threaded onto the proximal end of the handle 3; now, the fixing piece 4 may be fixed and hidden inside the handle 3 (as shown in FIG. 3) or may extend out of the handle 3 (as shown in FIG. 4).

When the umbrella is assembled, the distal end of the handle 3 is connected with the proximal end of the extension pole 2 through the engagement between the resilient engagement element 22 of the extension pole 2 and the engagement hole 31 of the handle 3; now, the handle 3 is connected with the extension pole 2 and the central pole 15.

Figure 5:
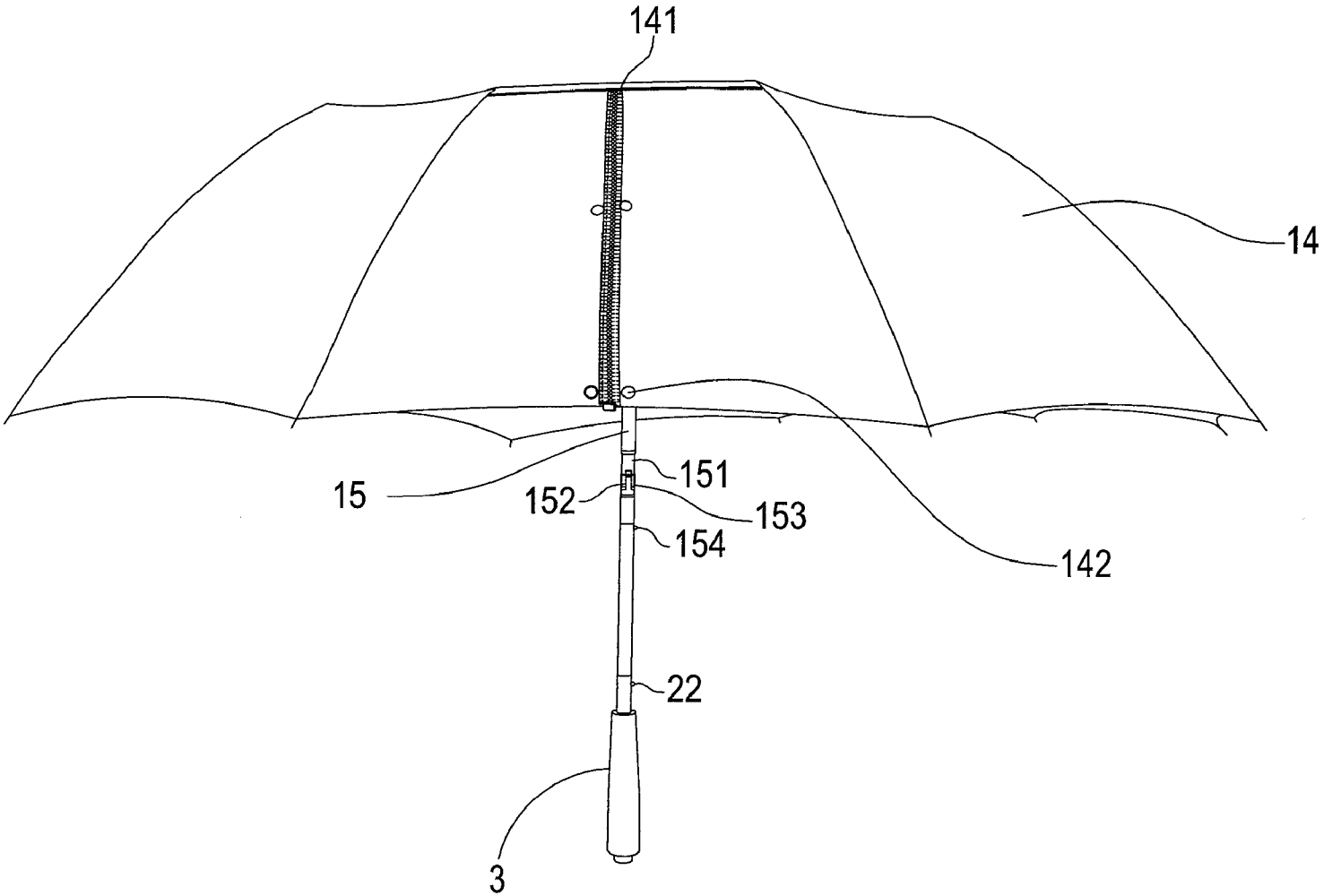
FIG. 5 is a view showing the improved hunting umbrella of the present invention when used as an ordinary umbrella.

Now, please refer to FIG. 5, which is the first type of use of the improved hunting umbrella of the present invention. When a user wishes to use the hunting umbrella as an ordinary umbrella, he may close the zipper 141 (so that there is not any gap formed on the piece of fabric 14) and move the outer tubular portion 153 downwards (so that the central pole 15 can not be bent). Now, the user may use the hunting umbrella to protect him from the sun or the rain through the piece of fabric 14.

Figure 6:
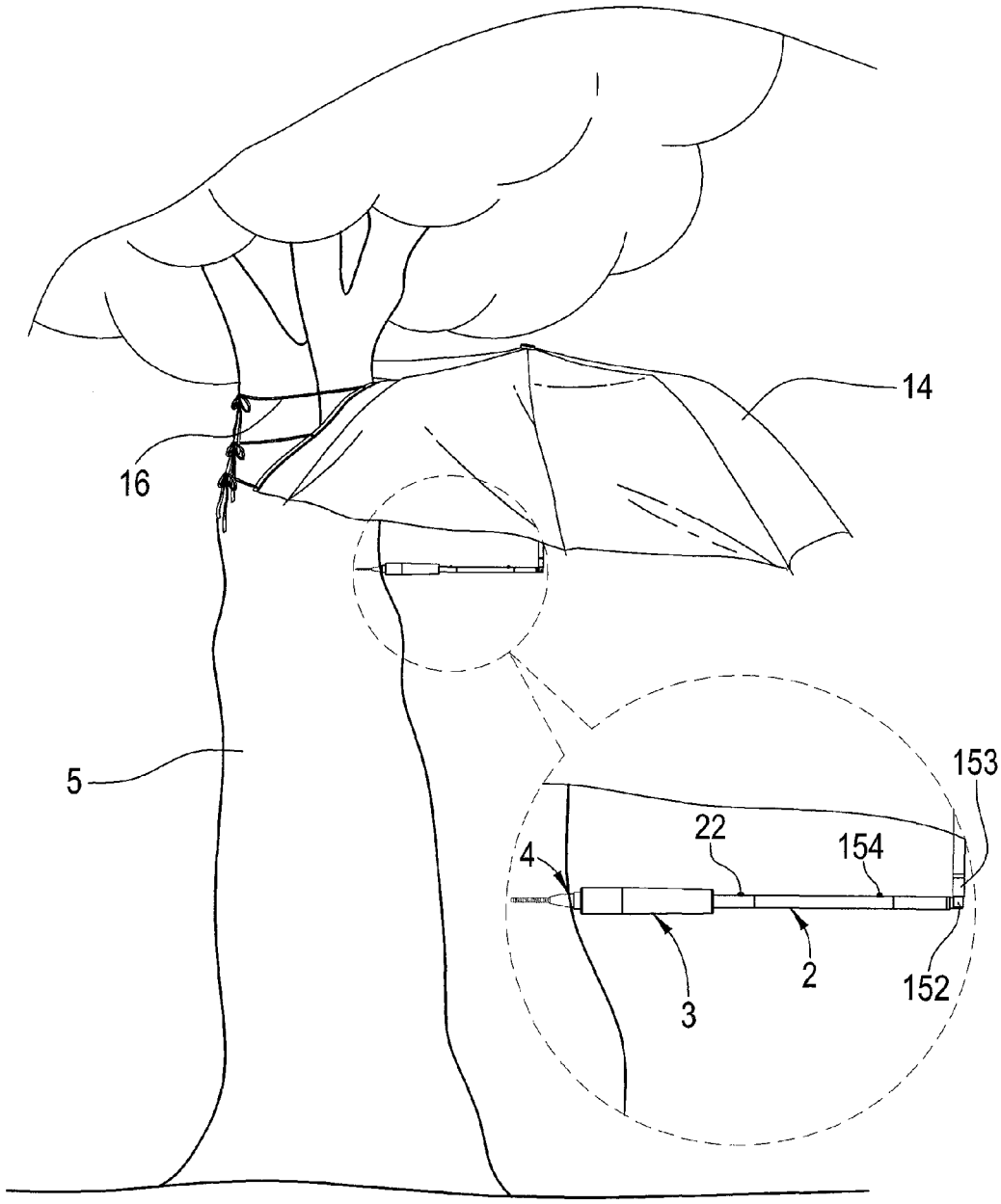
FIG. 6 is a view showing the improved hunting umbrella of the present invention when used as a hunting umbrella.

Now, please refer to FIG. 6, which illustrates the second type of use of the improved hunting umbrella of the present invention. When a user wishes to use the hunting umbrella as a hunting umbrella, he may unzip the zipper 141 (so that a gap may be formed on the piece of fabric 14) and connect two bands with the buttons 142. Then, he may move the outer tubular portion 153 upwards (so that the central pole 15 can be bent by about 90 degree and the main body 1 is perpendicular to the extension pole 2 and the handle 3) and make the fixing piece 4 extend out of the handle 3 (so that the fixing piece 4 can attach the hunting umbrella to a tree 5). Now, a gap formed on the piece of fabric 14 provides a space for the trunk of the tree 5. The user may tie the two bands around the trunk so that rain will not fall through the space between the trunk and the piece of fabric 14.

In contrast to the hunting umbrellas of the prior art, the improved hunting umbrella of the present invention has the following two advantages:

1. A zipper is provided on a piece of fabric of the umbrella. When the zipper is closed, the umbrella may be used as an ordinary umbrella to protect a user from the sun or the rain. When the zipper is unzipped, a gap is formed on the piece of fabric so as to allow the umbrella to be attached to a tree.

2. The improved hunting umbrella of the present invention is structurally simple, easy to assemble and very useful.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An improved hunting umbrella, comprising:

a main body, including a plurality of ribs, an upper retaining element, a lower retaining element, a piece of fabric and a central pole, wherein a zipper is disposed on the piece of fabric, a bendable portion is provided on the central pole, and a resilient engagement element is disposed near the proximal end of the central pole;

an extension pole, wherein an engagement hole is provided near the distal end of the extension pole and a resilient engagement element is disposed near the proximal end of the extension pole, characterized in that, when the umbrella is assembled, the distal end of the extension pole is connected with the proximal end of the central pole through the engagement between the resilient engagement element of the central pole and the engagement hole of the extension pole so that the central pole may be connected with the extension pole; and a handle, wherein a second engagement hole is provided near the distal end of the handle and a fixing piece having a flat threaded base at one end and a pointed stake extending at an opposite end is threaded onto the proximal end of the handle via the flat threaded base in either of two directions so that the pointed stake may be securely fixed inside the handle or may extend out of the handle, characterized in that, when the umbrella is assembled, the distal end of the handle is connected with the proximal end of the extension pole through the engagement between the resilient engagement element of the extension pole and the second engagement hole of the handle so that the handle may be connected with the extension pole; and when the fixing piece is threaded onto the handle with the pointed stake extending out of the handle, the pointed stake is capable of being staked into a tree for fixing the hunting umbrella.

2. The improved hunting umbrella as in claim 1, wherein a gap is formed on the piece of fabric when the zipper is unzipped.

3. The improved hunting umbrella as in claim 1, wherein a plurality of buttons are provided on each side of the zipper and each button may be connected with a band.

4. The improved hunting umbrella as in claim 1, wherein the bendable portion is provided on a sliding tubular portion of the central pole and an outer tubular portion is disposed outside of the bendable portion and may move upwards and downwards along the sliding tubular portion, and characterized in that, when the outer tubular portion is moved to the position of the bendable portion, the bendable portion can not be bent.

5. The improved hunting umbrella as in claim 1, wherein the central pole may be bent by about 90 degree.

6. The improved hunting umbrella as in claim 1, wherein the extension pole is a hollow tube.

* * * * *